US008692633B2

(12) United States Patent
Naruo

(10) Patent No.: US 8,692,633 B2
(45) Date of Patent: Apr. 8, 2014

(54) SWITCH WITH RESET FUNCTION

(71) Applicant: Omron Corporation, Kyoto (JP)

(72) Inventor: Toshihiro Naruo, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 13/653,810

(22) Filed: Oct. 17, 2012

(65) Prior Publication Data

US 2013/0106541 A1 May 2, 2013

(30) Foreign Application Priority Data

Nov. 1, 2011 (JP) ..... 2011-240682

(51) Int. Cl.
*H01H 9/20* (2006.01)

(52) U.S. Cl.
USPC ..... 335/166; 200/524

(58) Field of Classification Search
USPC ..... 335/2, 166, 167; 200/318–327, 200/520–524
See application file for complete search history.

(56) References Cited

U.S. PATENT DOCUMENTS

| | | | | |
|---|---|---|---|---|
| 4,543,459 | A * | 9/1985 | Hayashida | 200/453 |
| 6,207,914 | B1 * | 3/2001 | Mori | 200/524 |
| 6,445,090 | B1 * | 9/2002 | Mori et al. | 307/119 |

FOREIGN PATENT DOCUMENTS

| | | |
|---|---|---|
| EP | 1 050 893 | 11/2000 |
| JP | 03277972 | 4/2002 |

* cited by examiner

*Primary Examiner* — Bernard Rojas
(74) *Attorney, Agent, or Firm* — Foley & Lardner LLP

(57) ABSTRACT

A switch is provided with a reset function including a heart cam portion which extends from a locked position to a side where a lock pin operation end biases, and a lock release passage IV which is blocked off by a lock pin retention protrusion during being retained. The lock pin retention protrusion is moved by biasing force of the lock pin operation end so that the locked state is released by opening the lock release passage IV. This embodiment can decrease wear between the lock pin and the member for retaining the lock pin.

16 Claims, 10 Drawing Sheets

SWITCH WITH RESET FUNCTION

TECHNICAL FIELD

The present embodiments relate to a switch with a reset function.

BACKGROUND ART

Conventionally, there has been proposed a switch having a self-return function (reset function) for releasing an ON state (locked state) (hereinafter referred to as a switch with a reset function). A switch with a reset function is disclosed in, for example, Japanese Patent No. 3277972 (registered on Feb. 15, 2002).

A switch of this kind has a driving cam which is driven by an attractive force of a solenoid. Then, this driving cam is driven so as to move a lock pin which is retained by a lock cam retention portion, thereby releasing the locked state. FIGS. 9A to 10B illustrate the structure of the switch with the reset function and the structure of the lock release mechanism which are disclosed in Japanese Patent No. 3277972.

In the switch with the reset function disclosed in Japanese Patent No. 3277972, a slider member 121 is pressed inward so as to bring the switch into the lock position (FIG. 9A). Under this state, an operation end 127*b* of the lock pin 127 is retained by a lock cam retention portion 130 so that the slider member 121 is locked at the pressed-in position.

Under the state of FIG. 9A, when the self-return function (reset function) is operated, a solenoid (not shown) is magnetized so that a drive cam 123 is driven via an iron core (not shown) by an attractive force of the solenoid, thereby being rotated about a cam protrusion portion 126 in a counterclockwise direction. Then, as illustrated in FIG. 9B, a distal end portion 124 of the drive cam 123 moves substantially along the slide direction of the slider member 121. Next, an inclined surface 125*a* of the drive cam 123 abuts against the operation end 127*b* of the lock pin 127 so that the operation end 127*b* is moved by the inclined surface 125*a* in a direction in which the operation end 127*b* is released from the lock cam retention portion 130 (the downward direction on the sheet of FIG. 9B), thereby releasing the lock.

As illustrated in FIG. 10A, when the lock is released, the slider member 121 is slid in the left direction on the sheet of FIG. 10A by the biasing force of a spring member for returning (not shown).

The slider member 121 is slid in the left direction so that the operation end 127*b* of the lock pin 127 is moved upward on the sheet of FIG. 10A by a heart cam portion 129. The drive cam 123 is rotated clockwise about the cam protrusion portion 126 via the inclined surface 125*a* in accordance with the movement of the operation end 127*b* of the lock pin 127. As illustrated in FIG. 10B, when the returning of the slider member 121 is completed, the operation end 127*b* of the lock pin 127 is moved by the heart cam portion 129 to a position which is slightly above the lock position, and, under this state, the operation end 127*b* of the lock pin 127 is positioned at the mountain-shaped top portion formed by the inclined surfaces 125*a*, 125*b*.

However, there is a problem in the switch with the reset function disclosed in Japanese Patent No. 3277972 that the distal end 124 of the drive cam 123 and the operation end 127*b* of the lock pin 127 are caused to be worn down.

As illustrated in FIG. 9, in the switch with the reset function disclosed in Japanese Patent No. 3277972, under the locked state, the operation end 127*b* of the lock pin 127 is retained by the lock cam retention portion 130 under a state of being biased in a pressing-in direction of the slider member 121. The distal end portion 124 of the drive cam 123 abuts against the operation end 127*b* with driving force which is applied in a direction opposite to the biasing direction of the operation end 127*b* and is greater than the biasing force in order to perform the self-returning (reset) function. The operation end 127*b* moves under this state along the inclined surface 125*a* of the drive cam 123 so that the distal end portion 124 of the drive cam 123 and the operation end 127*b* of the lock pin 127 are caused to be worn down.

As a result, the switch with the reset function disclosed in Japanese Patent No. 3277972 may be degraded in its reset function due to lowering of the durability of the drive cam 123 and the lock pin 127.

SUMMARY

The present embodiments have been devised to solve the problems described above, and an object of the embodiments is to provide a switch with a reset function which can decrease wear between the lock pin and a member for retaining the lock pin.

In accordance with one aspect of the present embodiments, in order to solve the above-mentioned problem, a switch with a reset function includes: a press-in member which performs opening and closing operations of a circuit by a press-in operation in a first direction; a lock pin including one end which is connected to the press-in member and an operation end that is on an opposite end of the lock pin from the press-in member; a cam portion including a cam groove that guides the operation end when the press-in member moves; a retention portion that retains the operation end biased in a second direction opposite to the first direction so as to hold the operation end in a locked position; and a release mechanism that releases a retention between the retention portion and the operation end by inputting an external signal, wherein the cam portion includes a lock release cam groove that extends from the locked position to a side to which the operation end is biased, and is blocked off by the retention portion during the retention, wherein the release mechanism moves the retention portion in the second direction to open the lock release cam groove, thereby releasing the retention.

This switch with the reset function is configured to include a press-in member which performs opening and closing operations of a circuit by a press-in operation in a first direction; a lock pin including one end which is connected to the press-in member and an operation end that is on an opposite end of the lock pin from the press-in member; a cam portion including a cam groove that guides the operation end when the press-in member moves; a retention portion that retains the operation end biased in a second direction opposite to the first direction so as to hold the operation end in a locked position; and a release mechanism that releases a retention between the retention portion and the operation end by inputting an external signal, so that the operation end of the lock pin is configured to slide in the cam groove of the cam portion while being interlocked with the opening and closing operations of the circuit (switch circuit) by the press-in operation of the press-in member. Then, under the locked state in which the close state of the circuit is maintained, the operation end is made in the state of being biased in the second direction opposite to the first direction so as to be retained at the locked position by means of the retention by the retention portion. Then, when the external signal is input, the release mechanism releases the retention between the retention portion and the operation end so as to release the locked state, thereby resetting the switch to the OFF state.

Furthermore, the cam portion extends from the locked position to the side to which the operation end is biased, and includes the lock release cam groove which is blocked off by the retention portion under the state of being retained. The release mechanism moves the retention portion in the second direction by a biasing force of the operation end so that the lock release cam groove is opened so as to release the retention, and the retention portion is returned to the locked position by applying the return force to the retention portion in the first direction.

According to this structure, when the external signal is input, the operation end under the locked state (of being retained by the retention portion) is moved in the second direction by means of the release mechanism. As a result, the retention portion is moved in the second direction so as to open the lock release cam groove, and the operation end is made to slide in the lock release cam groove. Moreover, the lock release cam groove extends from the locked position to the side to which the operation end is biased so that the operation end slides in the lock release cam groove without resisting its biasing force so as to release the locked state.

Therefore, according to the above-mentioned structure, comparing to the conventional switch with the reset function in which the operation end is moved in the direction opposite to the biasing direction of the operation end with the driving force greater than this biasing force (while resisting the biasing force of the operation end), the wear between the lock pin and the retention portion can be decreased.

Therefore, according to the above-mentioned structure, there can be provided a switch with a reset function which can decrease the wear between the lock pin and the member for retaining the lock pin.

Moreover, the switch with the reset function according to the present embodiments preferably further includes: a sliding member including the retention portion; a solenoid member including an iron core and a solenoid main body to fix the retention portion of the sliding member to the locked position by an attractive force between the iron core and the solenoid main body; and an elastic member that generates a return force smaller than a biasing force of the operation end when the sliding member moves in the second direction, wherein the release mechanism makes the retention portion movable in the second direction by inputting the external signal into the solenoid member so as to release a fixing between the sliding member and the solenoid member.

In the conventional switch with the reset function, the drive cam is driven by the attractive force of the solenoid via the iron core so as to be rotated about the cam protrusion portion in a counterclockwise, thereby using the principle of lever for the drive mechanism of the drive cam. As a result, there is a second problem that the switch is made to be large in size.

Moreover, in the conventional switch with the reset function, when releasing the locked state, the drive cam is supported by only the iron core of the solenoid and the lock pin. As a result, there is a third problem that the drive cam is easily released from the lock pin when shock or vibration is externally applied to the drive cam.

According to the above-mentioned structure, the second and third problems in the conventional switch with the reset function are not raised.

In the above-mentioned structure, the sliding member having the retention portion is fixed by the attractive force between the iron core and the solenoid main body in the solenoid member so that the retention member for retaining the lock pin (the sliding member in this case) is more stably fixed than the conventional switch with the reset function. Therefore, according to the above-mentioned structure, there is a switch with a reset function in which the sliding member is not released from the lock pin even when shock or vibration is externally applied to the sliding member.

Furthermore, according to the above-mentioned structure in the release mechanism, the external signal is input into the solenoid member so as to release the fixing of the sliding member and the solenoid member, thereby making the retention portion movable in the second direction. Therefore, the principle of lever, which is used for the conventional switch with the reset function, is not needed. As a result, there is a miniaturized switch with a reset function.

Moreover, in the switch with the reset function according to the present embodiments, it is preferred that the release mechanism moves the retention portion in the second direction by a biasing force of the operation end so as to open the lock release cam groove.

According to the above-mentioned structure, in the release mechanism, the retention portion is moved in the second direction by the biasing force of the operation end so as to open the lock release cam groove so that there is no need to dispose a member for moving the retention portion in the second direction at the release mechanism. Therefore, according to the above-mentioned structure, the release of the locked state occurs with a simpler structure.

Moreover, in the switch with the reset function according to the present embodiments, it is preferred that the release mechanism applies a return force to the retention portion in the first direction so as to return the retention portion to the locked position.

According to the above-mentioned structure, the release mechanism applies the return force to the retention portion in the first direction so as to return the retention portion to the locked position. As a result, there can be obtained an advantageous effect that, after the locked state is released, the locked state can be restored quickly, and the operation can be performed smoothly.

Moreover, in the switch with the reset function according to the present embodiments, it is preferred that the cam portion is provided with a cam groove for an ON operation which guides the operation end in accordance with a movement of the press-in member during the ON operation; and a cam groove for an OFF operation which guides the operation end in accordance with a movement of the press-in member during the OFF operation.

In the switch with the reset function according to the present embodiments, in addition to the lock release cam groove, the cam portion is provided with the cam groove for the ON operation which guides the operation end in accordance with the movement of the press-in member during the ON operation; and the cam groove for the OFF operation which guides the operation end in accordance with the movement of the press-in member during the OFF operation. Namely, the switch with the reset function according to the present embodiments is provided with a so-called "heart cam." The present embodiments can be applied to a switch which is provided with such a heart cam.

As mentioned above, in the switch with the reset function according to the present embodiments, the cam portion extends from the locked position to the side to which the operation end is biased, and includes the lock release cam groove which is blocked off by the retention portion during the retention, and the release mechanism moves the retention portion in the second direction by the biasing force of the operation end so as to open the lock release cam groove, thereby releasing the retention.

As a result, according to the present embodiments, there can be provided a switch with a reset function which can decrease the wear between the lock pin and the member for retaining the lock pin.

DETAILED DESCRIPTION

Hereinafter, an embodiment will be described with reference to the drawings.

(1) Structure of Switch with Reset Function

Figure 1A:
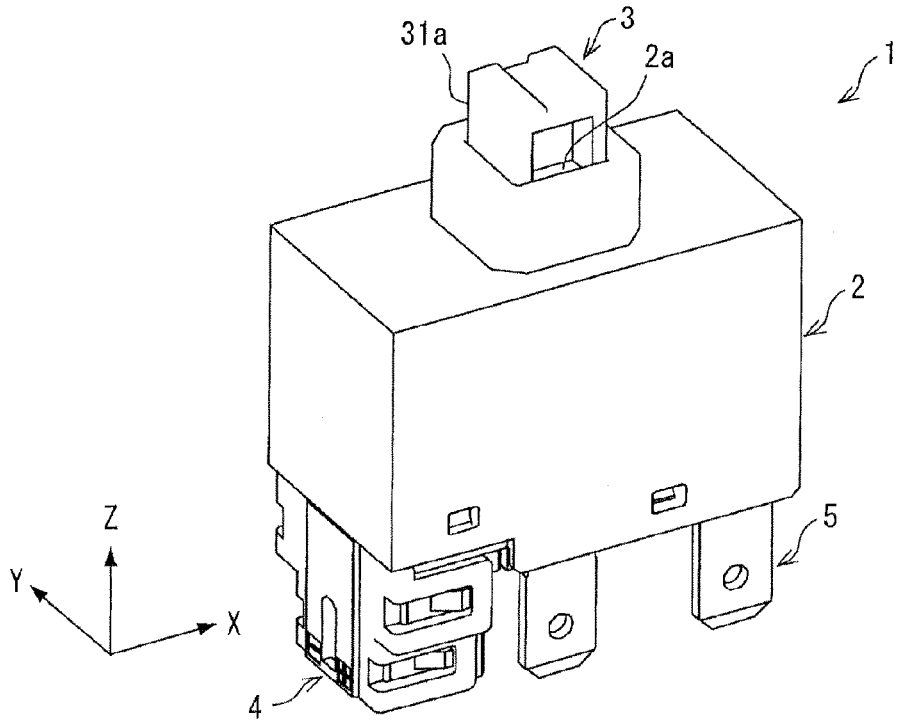
FIGS. 1A and 1B are perspective views illustrating external appearances of a switch (switch with a reset function) of an embodiment.
Figure 1B:
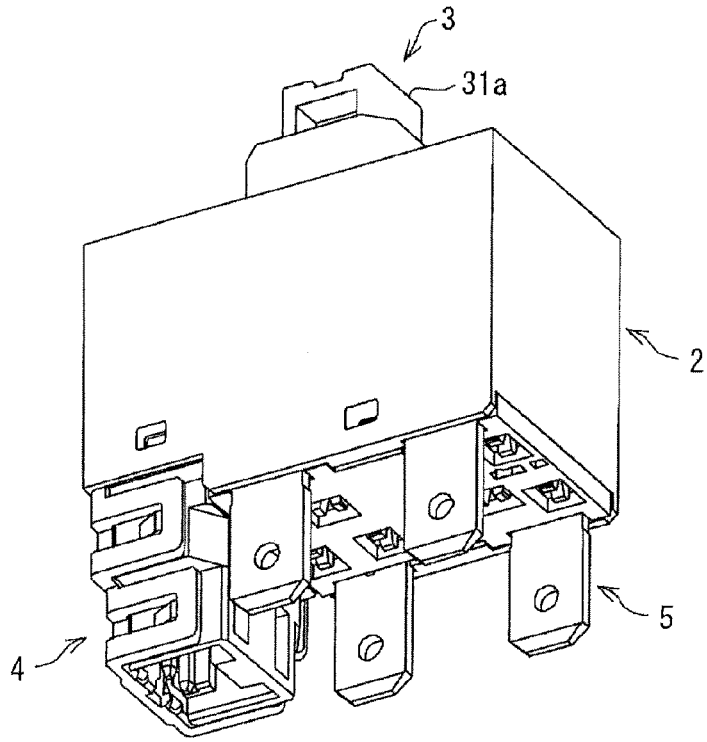
Figure 2:
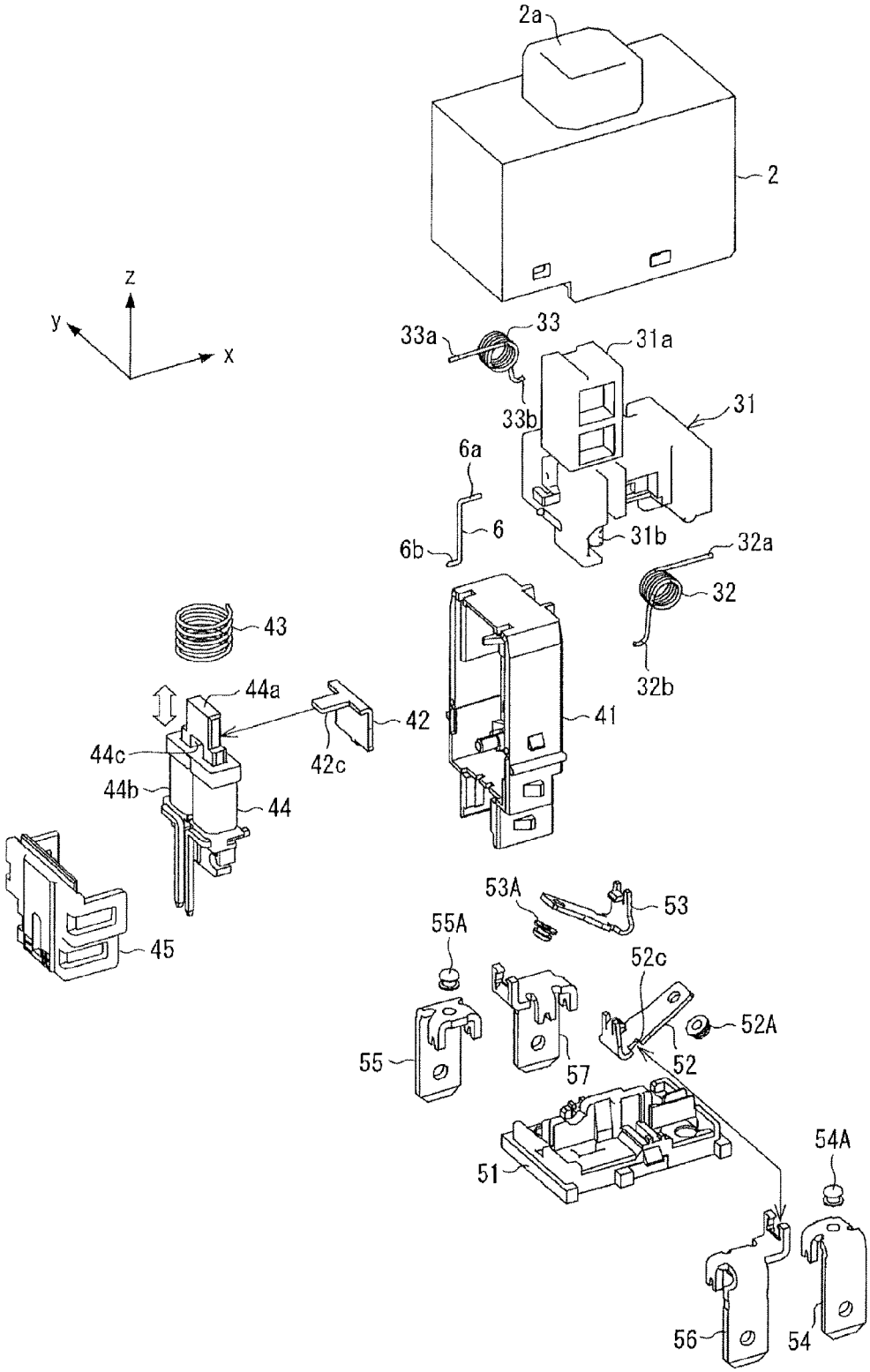
FIG. 2 is an exploded perspective view of the switch illustrated in FIGS. 1A and 1B.

First, a structure of a switch with a reset function according to the present embodiments is explained. FIGS. 1A and 1B are perspective views illustrating external appearances of a switch (switch with a reset function) 1 of the present embodiment. FIG. 2 is an exploded perspective view of the switch 1.

The switch 1 is a so-called push-type switch which includes a housing 2, a plunger portion 3 which is contained in the housing 2, a solenoid portion 4, and a terminal switching portion 5.

The plunger portion 3 includes a plunger main body (press-in member) 31, and contact springs 32, 33. The contact spring 32 has ends 32*a* and 32*b*. Similarly, the contact spring 33 has ends 33*a* and 33*b*. The plunger main body 31 includes an operation portion 31*a* for performing a press-in operation. Moreover, the housing 2 is provided with an insertion inlet 2*a* into which the operation portion 31*a* is inserted. Furthermore, the plunger main body 31 includes a contact spring attachment portion 31*b* to which the contact springs 32, 33 are attached.

In the switch 1, the press-in operation is performed by the operation portion 31*a* so as to control opening and closing of a switch circuit. When the press-in operation of the operation portion 31*a* is performed under an initial state (OFF state), while the operation portion 31*a* is being inserted into the inside of the housing 2, the switch circuit is closed so as to bring the switch 1 into an ON state. Then, the operation portion 31*a* passes through the position in which the operation portion 31*a* is most deeply pressed in, and protrudes from the housing 2 so as to become a locked state. Under this locked state, the switch 1 is locked while the switch circuit maintains its ON state. Then, the protruding operation portion 31*a* under the locked state is pressed in again, thereby opening the switch circuit so as to restore the switch 1 to the initial state. The switch 1 of the present embodiment includes a lock release mechanism (reset function) for releasing the locked state when a specific external signal is input. An opening and closing control mechanism and a lock release mechanism of the switch 1 will be described later.

A solenoid portion 4 includes a solenoid case 41, a slider member (sliding member) 42, a return spring 43, a solenoid member 44, and a solenoid cover 45. The solenoid member 44 is contained in space which is formed by the solenoid case 41 and the solenoid cover 45.

The slider member 42 and the return spring 43 are attached to the solenoid member 44. The slider member 42 is engaged with the solenoid member 44 at its slider engagement portion 42*c*. The solenoid member 44 includes an iron core 44*a* and a solenoid main body 44*b*, and the iron core 44*a* is inserted into the solenoid main body 44*b*. Moreover, the iron core 44*a* is provided with a recess portion 44*c*. The slider engagement portion 42*c* is inserted into this recess portion 44*c*. Note that, the solenoid main body 44*b* includes a yoke made of magnetic material, a permanent magnet, and a coil.

When a lock releasing signal (external signal) is not input into the solenoid member 44, an attractive force is generated between the iron core 44*a* and the solenoid main body 44*b* so as to be attracted to each other. The slider engagement portion 42*c*, which is inserted into the recess portion 44*c*, is fixed by this attractive force. As a result, the slider member 42 is fixed to the solenoid member 44 (this state is defined as an attracted state).

When the lock releasing signal (external signal) is input into the solenoid member 44, there is brought a state in which the attractive force between the iron core 44*a* and the solenoid main body 44*b* is cancelled. Then, the iron core 44*a* leaves the solenoid main body 44*b*. At this time, the slider member 42 is brought into a state in which the slider member 42 is not fixed to the solenoid member 44 (this state is defined as a separated state).

Note that, the direction of the attractive force, which attracts the iron core 44*a* and the solenoid main body 44*b* to each other, is the same as the direction of the pressing-in operation. Here, the direction of the pressing-in operation performed by the operation portion 31*a* is defined as a z-direction, and the direction in which the slider member 42 and the solenoid member 44 are opposed to each other is defined as an x-direction. The direction, which is orthogonal to both the direction of the pressing-in operation performed by the operation portion 31*a* and the direction in which the slider member 42 and the solenoid member 44 are opposed to each other, is defined as a y-direction.

Moreover, the terminal switching portion 5 includes a base 51, movable pieces 52, 53, contact terminals 54, 55, and common terminals 56, 57. The contact terminal 54 and the common terminal 56 are disposed so as to be adjacent to one side portion of the base 51 in the x-direction. The contact terminal 55 and the common terminal 57 are disposed so as to be adjacent the other side portion of the base 51 in the x-direction. Then, the contact terminal 54 and the common terminal 57 are opposed to each other, and the contact terminal 55 and the common terminal 56 are opposed to each other. Moreover, the movable pieces 52, 53 are respectively formed by plate-shaped bodies which are bent, and contacts 52A, 53A are attached to one ends of the same. Contacts 54A, 55A are respectively attached to the contact terminals 54, 55. In the switch 1, the contact 52A and the contact 54A are moved so as to make contact with each other, or be separated from each other, and the contact 53A and the contact 55A are moved so as to make contact with each other, or be separated from each other, thereby switching the OFF state to the ON state or vice versa.

A lock pin 6 is disposed between the plunger portion 3 and the solenoid portion 4. The lock pin 6 is formed by bending both ends of a round bar in opposite directions to each other at right angles to the axis of the round bar. Here, one end of the both bent ends is used as a lock pin fulcrum end 6*a*, and the other end is used as a lock pin operation end (operation end) 6*b*.

Figure 3:
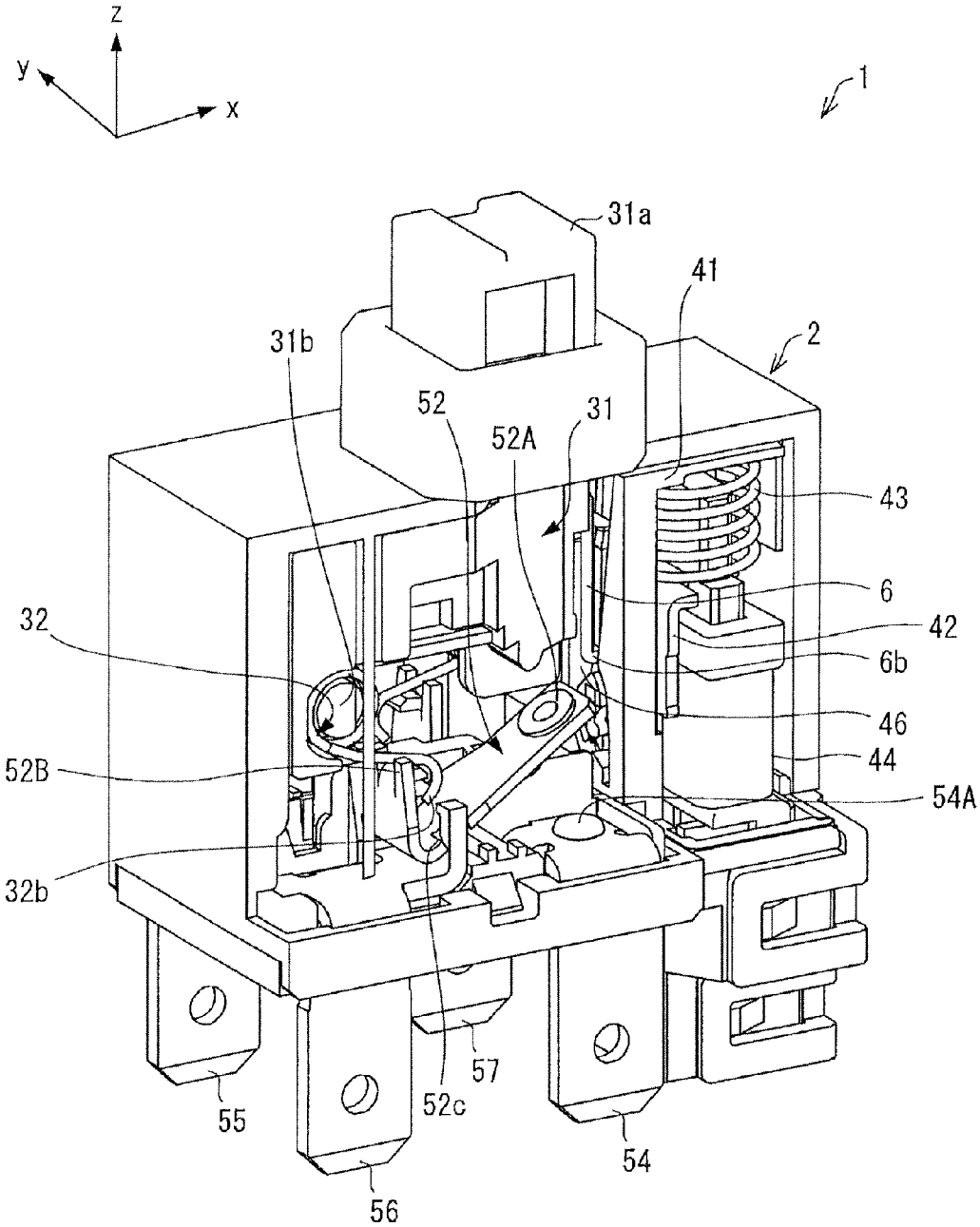
FIG. 3 is a perspective view illustrating an internal structure under an initial state of the switch illustrated in FIG. 1.

FIG. 3 is a perspective view illustrating an internal structure of the switch 1 under the initial state. The structures of the movable piece 53 and its associated contact spring 33 are omitted in FIG. 3 in order not to make the drawing complicated. Moreover, the structures of the movable piece 53 and its associated contact spring 33 are the same as those of the movable piece 52 and its associated contact spring 32 so that the explanations for the movable piece 53 and the contact spring 33 are omitted.

Here, a contact portion 52C of the movable piece 52, which makes contact with the common terminal 56, is defined as a fulcrum, and the end opposite to the contact 52A is defined as a power end 52B. As illustrated in FIG. 3, the movable piece 52 makes contact with the common terminal 56 at the fulcrum 52C. The movable piece 52 is disposed in such a way that the contact 52A is positioned above the contact 54A, which is attached to the contact terminal 54, in the z-direction. The plunger main body 31 is disposed above the contact 52A of the movable piece 52 in the z-direction.

Under the initial state, the plunger main body 31 and the contact 52A of the movable piece 52 are separated from each other by the contact spring 32. The contact spring 32 is formed by a helical metal wire which extends in the y-direction, and the both ends 32*a*, 32*b* of this metal wire are formed in linear shapes which extend in opposite directions to each other (refer to FIG. 2). Between both ends 32*a*, 32*b* of the contact spring 32, one end 32*a* is engaged with a lower surface of the plunger main body 31 in the z-direction, and the other end 32*b* is engaged with the power end 52B of the movable piece 52.

The solenoid case 41 is disposed so as to be opposed to the plunger main body 31 in the x-direction. The heart cam portion 46 is formed on the surface of the solenoid case 41 on the side which is opposed to the plunger main body 31.

Moreover, the lock pin fulcrum end 6*a* of the lock pin 6 is inserted into a hole which is formed in the plunger main body 31 (not shown). On the other hand, the lock pin operation end 6*b* abuts against the outer circumferential groove of the heart cam portion (cam portion) 46 which is formed in the solenoid case 41. The lock pin 6 is configured such that the lock pin operation end 6*b* is able to slide about the lock pin fulcrum end 6*a*. Accordingly, the lock pin operation end 6*b* is configured to slide in the outer circumferential groove of the heart cam portion 46 while being interlocked with the pressing-in operation by the operation portion 31*a* of the plunger main body 31.

Figure 4:
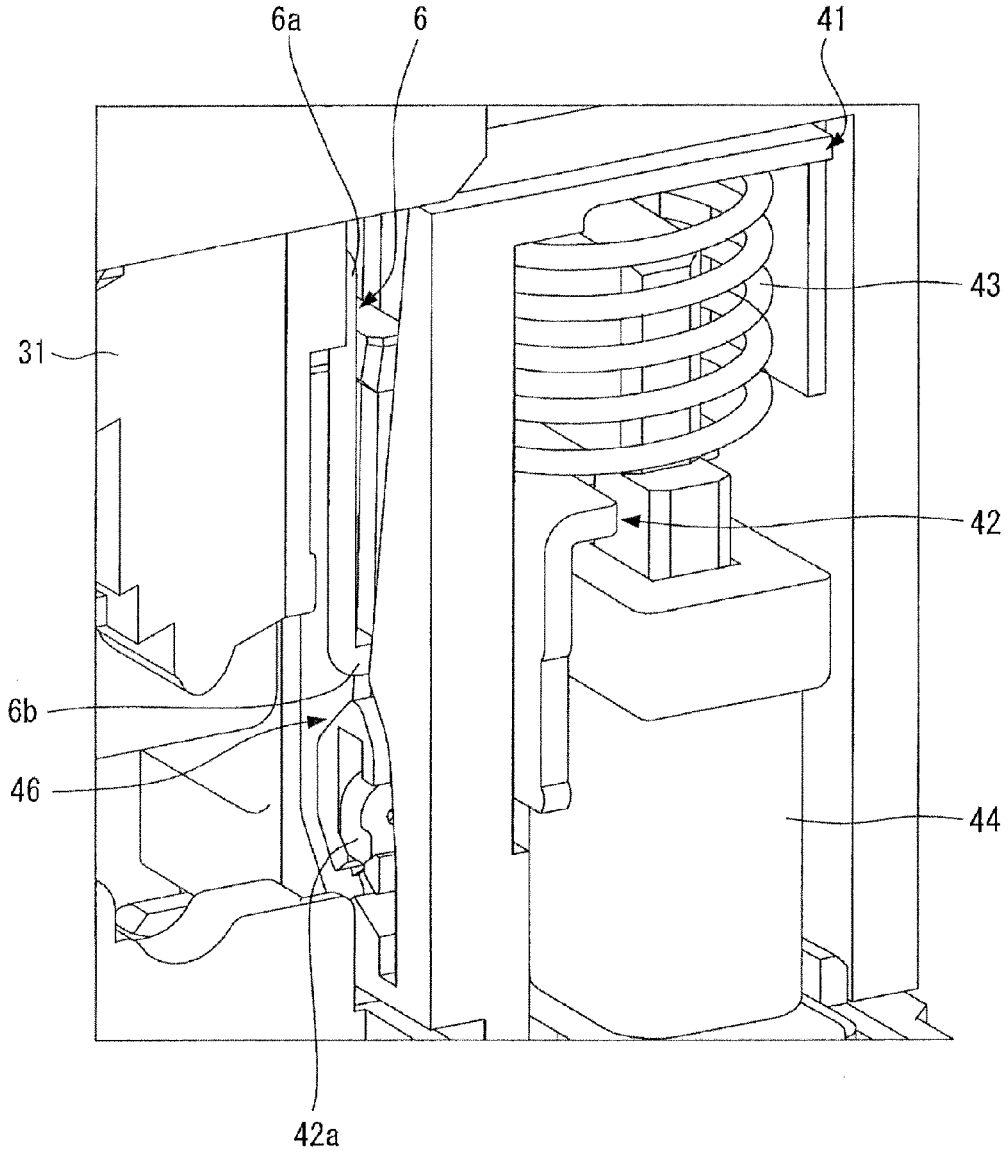
FIG. 4 is an enlarged perspective view illustrating a section adjacent to a heart cam portion of the switch illustrated in FIG. 1.
Figure 5A:
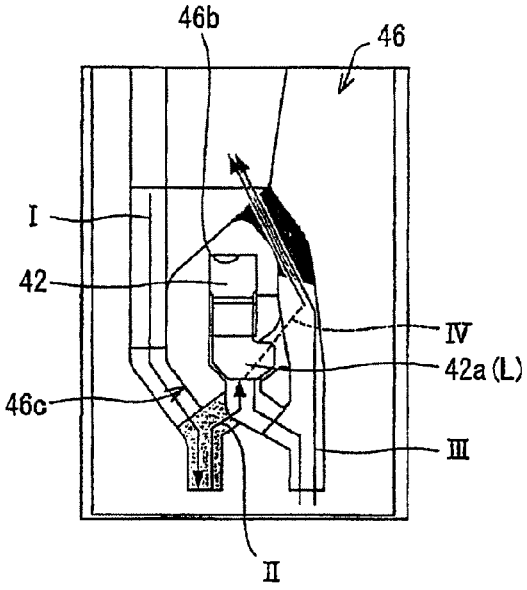
FIGS. 5A and 5B are top views illustrating a structure of an outer circumferential groove of the heart cam portion illustrated in FIG. 4.
Figure 5B:
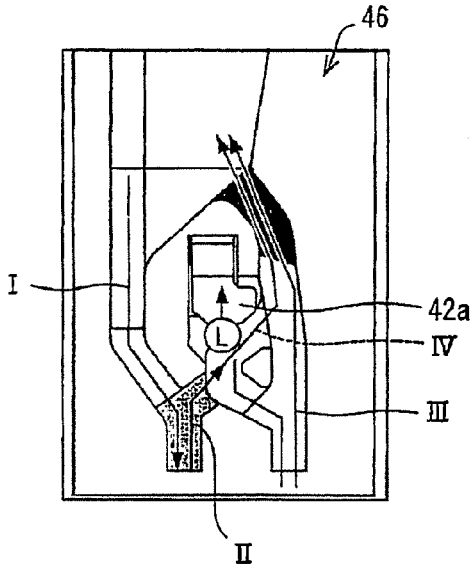

FIG. 4 is an enlarged perspective view illustrating a section adjacent to the heart cam portion 46 of the switch 1. FIGS. 5A and 5B are top views illustrating a structure of the outer circumferential groove of the heart cam portion 46.

As illustrated in FIG. 4 and FIGS. 5A and 5B, there is formed a lock pin retention protrusion portion 42*a*, which protrudes to the solenoid case 41 side, on the side of the slider member 42 opposite to the solenoid member 44. An insertion port 46*b*, into which the lock pin retention protrusion 42*a* is inserted, is formed in the side wall portion of the solenoid case 41, which is opposed to the slider member 42 (namely, the heart cam portion 46). The size of the insertion port 46*b* in the z-direction is set to be larger than the size of the lock pin retention protrusion portion 42*a* in the z-direction. Therefore, when the slider member 42 is brought into the separated state, and an upward force in the z-direction is applied to the lock pin retention protrusion 42*a* by the lock pin 6, the slider member 42 having the lock pin retention protrusion 42*a* is moved upward in the z-direction. The slider member 42, which has been moved upward in the z-direction, is applied with a return force downward in the z-direction by the return spring 43. As a result, the slider member 42 is moved upward in the z-direction, after that, the lock pin 6 is released from the lock pin retention protrusion 42*a* (slider member 42) which is disposed in the heart cam portion 46 so that the slider member 42 is moved by the return force downward in the z-direction so as to return to the original position.

As illustrated in FIGS. 5A and 5B, an outer circumferential groove (cam groove) 46*c* is disposed in the heart cam portion 46 so as to surround the lock pin retention protrusion 42*a*. This outer circumferential groove 46*c* is used as a guide groove for the lock pin operation end 6*b* which slides while being interlocked with the pressing-in operation of the plunger main body 31. The passage for the lock pin operation end 6*b* in the outer circumferential groove 46*c* comprises a switch on passage I, a lock passage II, a switch off passage III, and a lock release passage (cam groove for lock release) IV. A part of the switch off passage III is shared with the lock release passage IV. As illustrated in FIG. 5A, the lock release passage IV is blocked off by the lock pin retention protrusion 42*a* under the locked state, the OFF state, and the ON state. On the other hand, as illustrated in FIG. 5B, under the lock release state, the lock pin retention protrusion 42*a* is moved upward in the z-direction as mentioned above so as to be opened. Moreover, under the locked state, the lock pin operation end 6*b* is applied with upward force in the z-direction, and is brought into a state of being retained by the lock pin retention protrusion 42*a*. The position of the lock pin retention protrusion 42*a* under the locked state is defined as a locked position L.

(2) Opening and Closing Mechanism of Switch Circuit in Switch 1

Next, an opening and closing mechanism of the switch circuit in the switch 1 is explained. First, referring to FIG. 3, movements of the plunger main body 31 and the movable piece 52 during the opening and closing operations of the switch circuit are explained.

As mentioned above, under the initial state (before operation), the plunger main body 31 is engaged with one end 32*a* of the contact spring 32, and is biased upward in the z-direction by the elastic force of the contact spring 32. On the other hand, the other end 32*b* of the contact spring 32 presses down the power end 52B of the movable piece 52.

Then, when the operation portion 31*a* of the plunger main body 31 is pressed downward in the z-direction, the contact spring 32 is bent, and its end 32*b* slides on the upper portion of the power end 52B of the movable piece 52 so that the movable piece 52 is biased in a direction in which the movable piece 52 is raised up (a direction in which the contact 52A is displaced upward in the z-direction). Then, one end of the movable piece 52 is pressed down by the plunger main body 31. Furthermore, when the operation portion 31*a* of the plunger main body 31 is pressed in, and the end 32*b* of the contact spring 32 passes through a predetermined position, the movable piece 52 is biased by the end 32*b* of the contact spring 32 in a direction in which the movable piece 52 is pushed down (a direction in which the contact 52A is displaced downward in the z-direction). Accordingly, the movable piece 52 is momentarily rotated about the contact portion which makes contact with the common terminal 56 as the fulcrum, and the contact 52A of the movable piece 52 makes contact with the contact 54A of the contact terminal 54 (ON state).

Next, the operation portion 31*a* of the plunger main body 31 is pressed in to the lowermost position (TTP1), after that, when the pressure to the plunger main body 31 is released, the plunger main body 31 is pressed upward in the z-direction by the elastic force of the contact spring 32. On the other hand, the lock pin operation end 6*b* is retained at the locked position L (lock pin retention protrusion 42*a*) (refer to FIG. 6) so that the plunger main body 30 is prevented from returning upward in the z-direction so as to be brought into the locked state. Accordingly, the end 32*b* of the contact spring 32 continues to bias the movable piece 52 so as to be pushed down, and the contact 52A of the movable piece 52 continues to make contact with the contact 54A of the contact terminal 54.

Next, when the locked state is to be changed to the OFF state, the operation portion 31*a* of the plunger main body 31 is pressed down further in the z-direction so that the lock pin operation end 6*b* is separated from the lock pin retention protrusion 42*a*. Next, when the pressure to the operation portion 31*a* is released, while the contact spring 32 is biasing the movable piece 52 in the direction in which the movable piece 52 is pushed down, the plunger main body 31 is pressed upward in the z-direction. As a result, the plunger main body 31 returns to the original position. When the plunger main body 31 returns to the original position, the end 32*b* of the contact spring 32 biases the movable piece 52 in a direction in which the movable piece 52 is pulled up from the predetermined position. The movable piece 52 is momentarily rotated about the contact portion which makes contact with the common terminal 56 so that the contact 52A of the movable piece 52 is separated from the contact 54A of the contact terminal 54 (OFF state).

The lock pin 6 is connected to the plunger main body 31 via the lock pin fulcrum end 6*a* so as to move while being interlocked with the plunger main body 31 during the opening and closing operations of the switch circuit. The lock pin operation end 6*b* slides in the outer circumferential groove 46*c* which is formed in the heart cam portion 46 while being interlocked with the pressing-in operation of the plunger main body 31.

Figure 6:
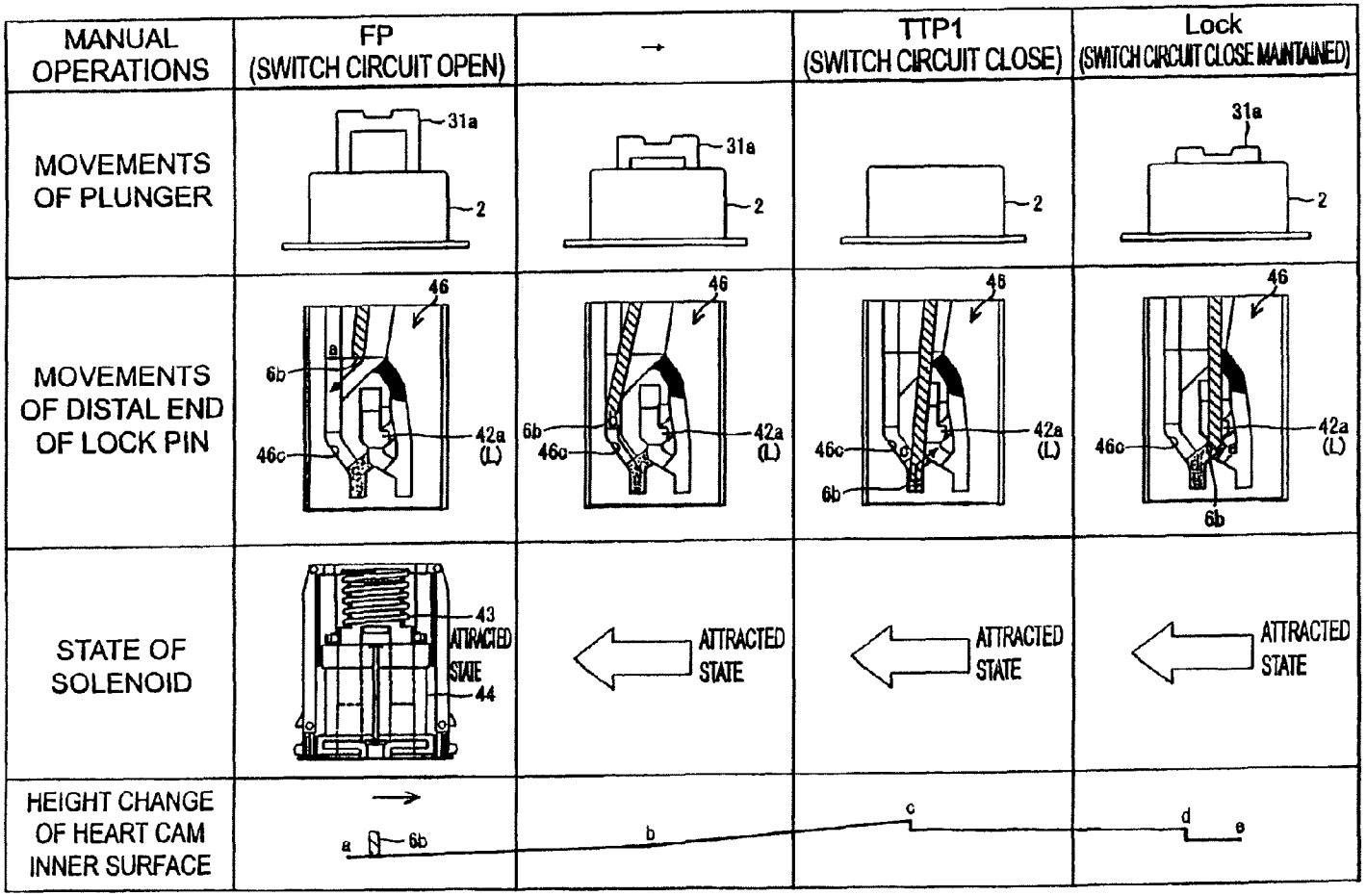
FIG. 6 is a table illustrating movements of an operation end of a lock pin in the heart cam portion during a closing operation of a switch circuit and a locking operation for maintaining an ON state.
Figure 7:
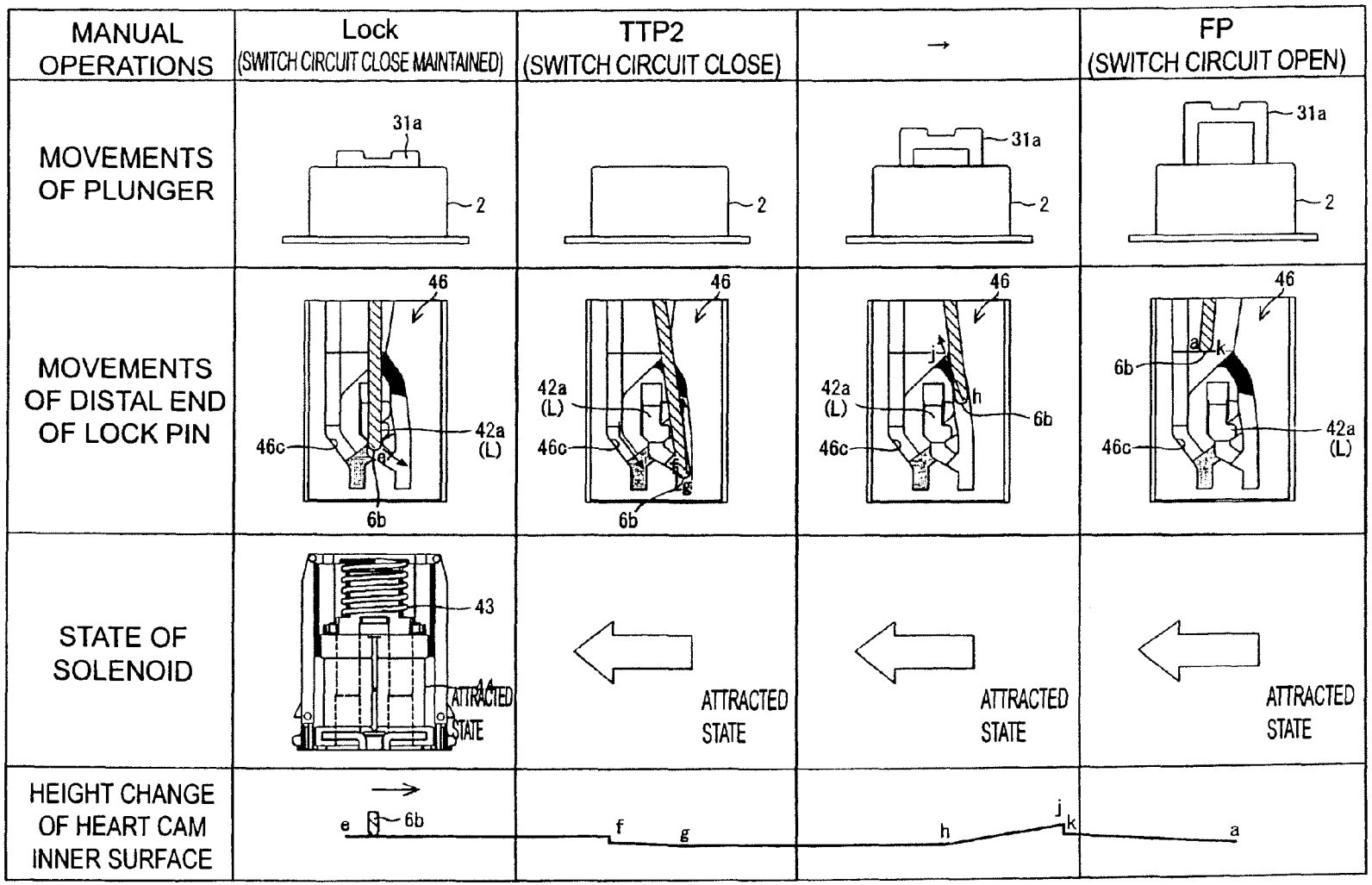
FIG. 7 is a table illustrating movements of the operation end of the lock pin in the heart cam portion during an opening operation of the switch circuit.

Next, the movements of the lock pin operation end 6*b* which are interlocked with the opening and closing operations of the switch circuit in the switch 1 are explained in detail. FIG. 6 is a table illustrating the movements of the lock pin operation end 6*b* in the heat cam portion 46 during the closing operation of the switch circuit (the operation from the OFF state to the ON state), and the locking operation for locking the ON state (the operation from the ON state to the locked state). Moreover, FIG. 7 is a table illustrating the movements of the lock pin operation end 6*b* in the heart cam portion 46 during the opening operation of the switch circuit (the operation from the locked state to the OFF state). The tables shown in FIGS. 6 and 7 also illustrate, in accordance with the movements of the lock pin operation end 6*b*, the movement of the operation portion 31*a* of the plunger main body 31, the states of the solenoid member 44 and the slider member, and the height change of the bottom surface of the outer circumferential groove 46*c* (the inner surface viewed from the plunger main body side).

First, the closing operation of the switch circuit and the movement of the lock pin operation end 6*b* which is interlocked with the locking operation are explained. In FIG. 6, positions a, b, and c of the outer circumferential groove 46*c* are positions which are located in the switch on passage I illustrated in FIGS. 5A and 5B. Moreover, positions d and e are positions which are located in the lock passage II. As illustrated in FIG. 6, during the period in which the switch 1 is changed from the OFF state to the ON state by the pressing-in operation of the operation portion 31*a* (the period from the "switch circuit open" to the "switch circuit close"), the lock pin operation end 6*b* passes through the positions a, b, and c in this order so as to become the ON state. Here, in the switch on passage I, the level of the bottom surface of the outer circumferential groove 46*c* is shifted to the solenoid main body 31 side in the x-direction with the position c being the border so as to form a difference in level. With this, once the lock pin operation end 6*b* has passed through the position c so as to become the ON state, the lock pin operation end 6*b* is prevented from returning to the positions a, b sides.

Next, the operation portion 31*a* of the plunger main body 31 is pressed in to the lowermost position (TTP1). After that, when the pressure to the plunger main body 31 is released, the lock pin operation end 6*b* is biased upward in the z-direction by the elastic force of the contact spring 32. Then, the lock pin operation end 6*b* passes through the positions d, e of the lock passage II, and is retained at the lock position L by the lock pin retention protrusion 42*a* so as to be prevented from moving upward in the z-direction. At this time, the operation portion 31*a* is brought into a state of protruding from the housing 2. Here, in the lock passage II, the level of the bottom surface of the outer circumferential groove 46*c* is shifted to the solenoid main body 31 side in the x-direction with the position d being the border so as to form a difference in level. With this, once the lock pin operation end 6*b* has passed through the position d so as to be retained at the lock position L, the lock pin operation end 6*b* is prevented from returning to the positions a to d sides. As a result, there is a switch which can maintain a stable locked state.

Note that, the solenoid member 44 maintains the attracted state during the closing operation of the switch circuit, and the locking operation for locking the ON state. Therefore, the lock pin retention protrusion 42*a* of the slider member 42 is fixed at the locked position L. Then, the lock pin operation end 6*b*, which is biased upward in the z-direction by the above-mentioned attractive force between iron core 44*a* and the solenoid main body 44*b*, is retained at the lock pin retention protrusion 42*a* (locked position L).

Next, the movement of the lock pin operation end 6*b*, which is interlocked with the opening operation of the switch circuit, is explained. In FIG. 7, positions f, g, h, j, and k of the outer circumferential groove 46*c* are positions which are located in the switch off passage III illustrated in FIGS. 5A and 5B. As illustrated in FIG. 7, when the operation portion 31*a* under the locked state is pressed down further, the lock pin operation end 6*b* passes through the positions e, f, g, and moves downward in the z-direction once. When the operation portion 31*a* is located at a position TTP2 which is the most pressed-in position, the lock pin operation end 6*b* is located at the position g. During the period in which the lock pin operation end 6*b* is passing through the positions e, f, and g, the switch circuit is kept in the ON state ("TTP2 (switch circuit close)" of FIG. 7). Then, when the pressure to the operation portion 31*a* is released, the lock pin operation end 6*b* at the position g is biased upward in the z-direction by the elastic force of the contact spring 32 so as to pass through the positions h, j, and k. The switch circuit is brought into the OFF state during the process in which the lock pin operation end 6*b* passes through the positions h, j, and k. Then, the lock pin operation end 6*b* returns to the position a ("FP (switch circuit open)" of FIG. 7).

Here, in the switch off passage III, the level of the bottom surface of the outer circumferential groove 46*c* is shifted to the solenoid main body 31 side in the x-direction with the position f being the border so as to form a difference in level. With this, once the lock pin operation end 6*b* has passed through the position f, the lock pin operation end 6*b* is prevented from returning to the locked position L. Therefore, the lock pin operation end 6*b* at the position g is prevented from returning to the locked position L by the biasing force upward in the z-direction by means of the contact spring 32. As a result, a stable off operation can be achieved.

Moreover, in the switch off passage III, the level of the bottom surface of the outer circumferential groove 46*c* is shifted to the solenoid main body 31 side in the x-direction with the position j being the border so as to form a difference in level. With this, the lock pin operation end 6*b*, which has passed through the position a, is prevented from returning to the switch off passage III again.

(3) Lock Release Mechanism in Switch 1 (Reset Mechanism)

Figure 8:
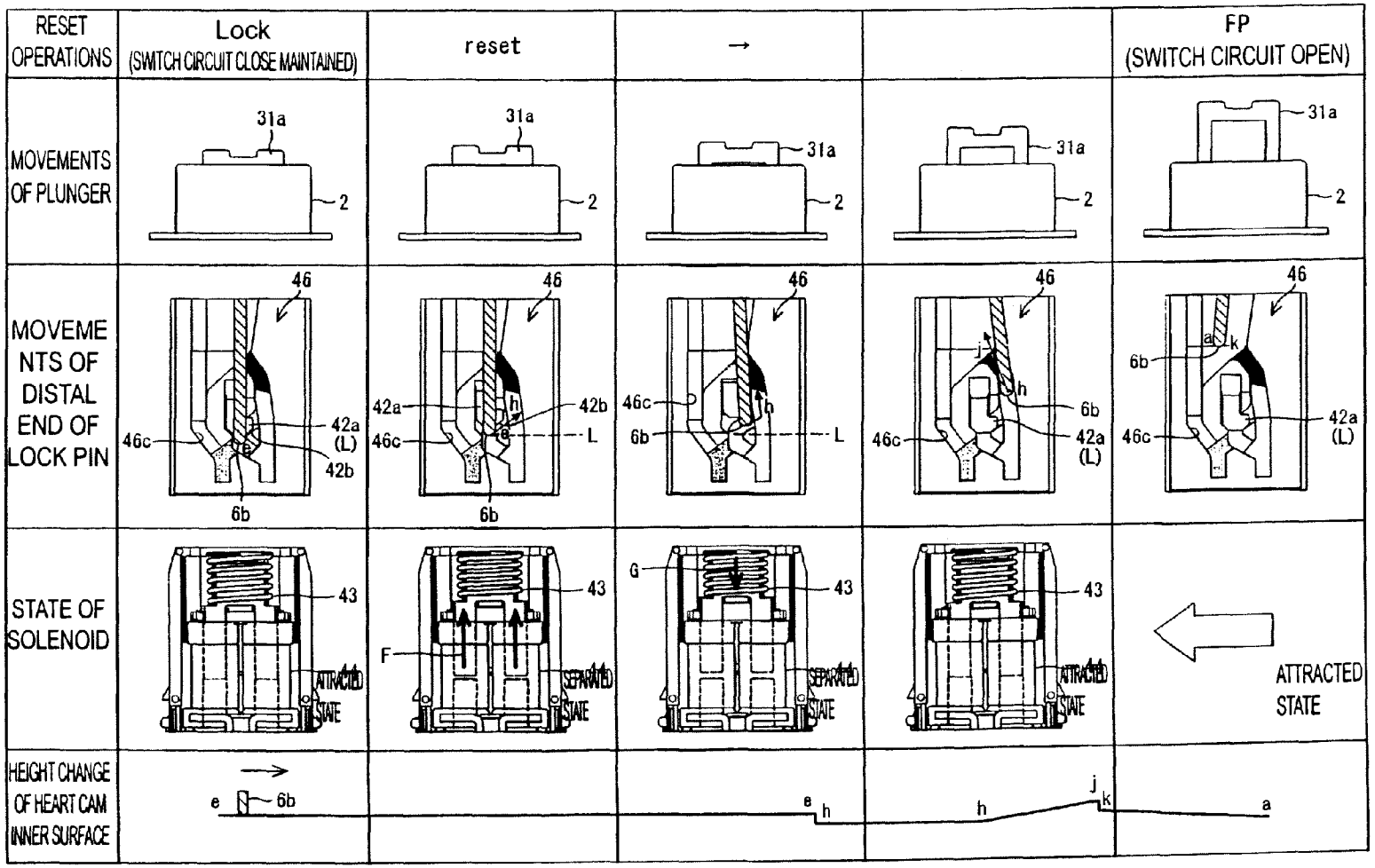
FIG. 8 is a table illustrating movements of the operation end of the lock pin in the heart cam portion during a lock releasing operation of a switch 1.
Figure 9A:
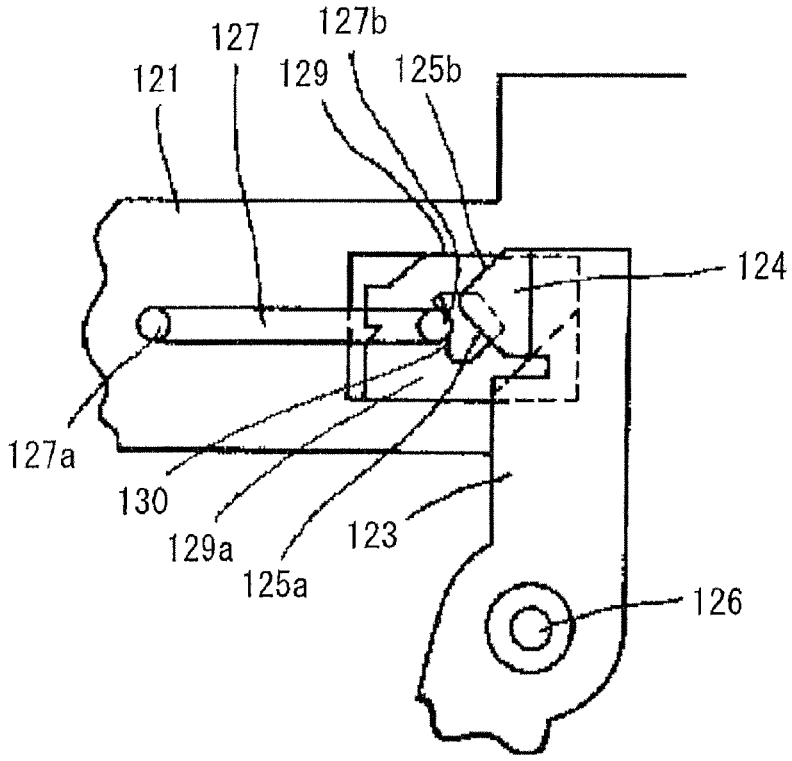
FIG. 9A Background Art
FIGS. 9A and 9B are drawings illustrating the structure of the switch with the reset function disclosed in Japanese Patent No. 3277972 and the structure of the lock releasing mechanism.
Figure 9B:
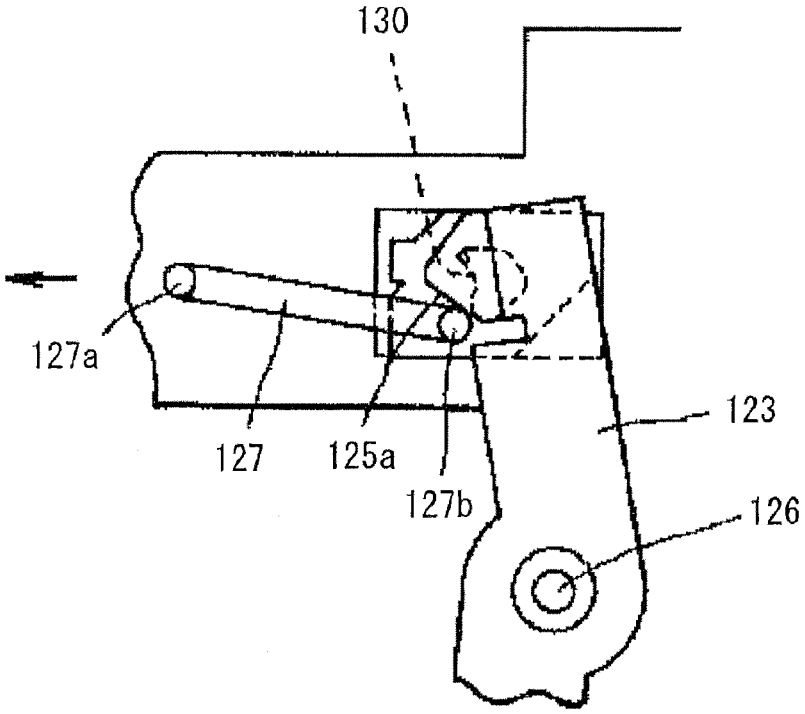
FIG. 9B Background Art
Figure 10A:
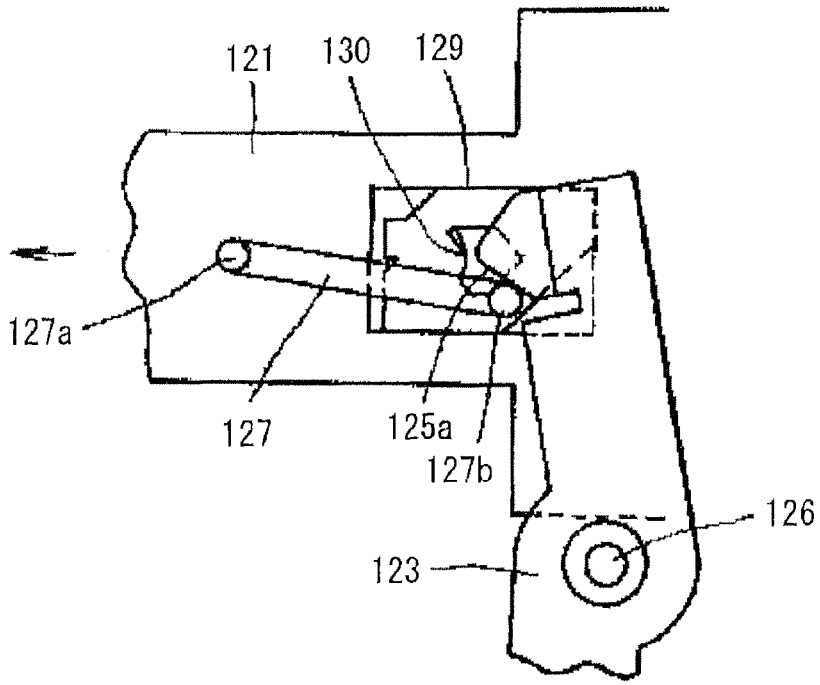
FIG. 10A Background Art
FIGS. 10A and 10B are drawings illustrating the structure of the switch with the reset function disclosed in Japanese Patent No. 3277972 and the structure of the lock releasing mechanism.
Figure 10B:
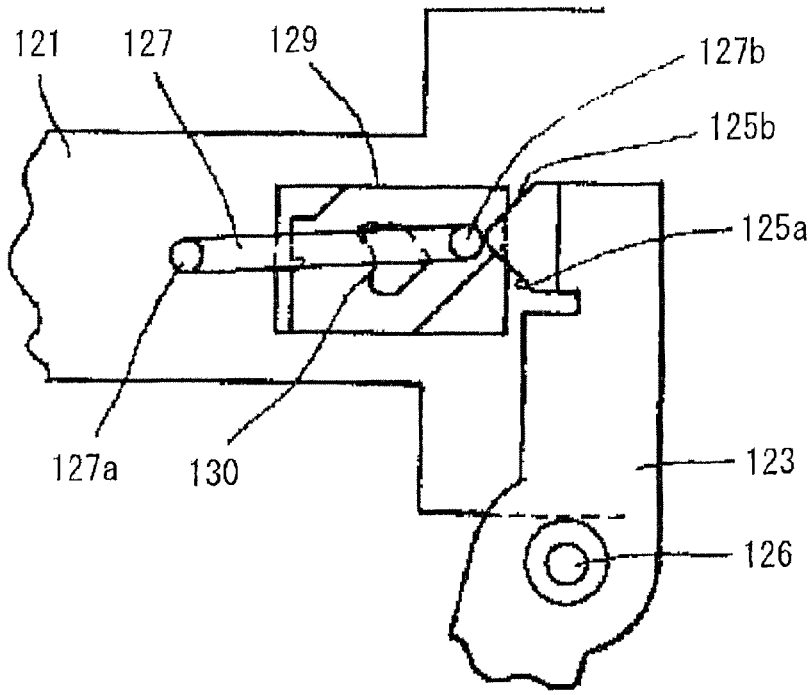
FIG. 10B Background Art

Next, a lock release mechanism, which is a characteristic of the switch 1, is explained. FIG. 8 is a table illustrating the movements of the lock pin operation end 6*b* in the heart cam portion 46 during the lock releasing operation of the switch 1. The table shown in FIG. 8 also illustrates, in accordance with the movements of the lock pin operation end 6*b*, the movement of the operation portion 31*a* of the plunger main body 31, the states of the solenoid member 44 and the slider member 42, and the height change of the bottom surface of the outer circumferential groove 46*c* (the inner surface viewed from the plunger main body side).

In FIG. 8, the passage extending from the position e of the outer circumferential groove 46*c* to the position h is the passage which is included in the lock release passage IV illustrated in FIGS. 5A and 5B.

As illustrated in FIG. 8, under the locked state (switch circuit close is maintained), the state of the solenoid member 44 is made to be the attracted state. Therefore, the lock pin retention protrusion 42*a* of the slider member 42 is fixed at the lock position L by the above-mentioned attractive force between the iron core 44*a* and the solenoid main body 44*b*. On the other hand, the lock pin operation end 6*b* is retained by the lock pin retention protrusion 42*a* under the state of being biased upward in the z-direction.

Then, when the lock release signal is input into the solenoid member 44 (reset), there is generated, at the solenoid member 44, force which cancels the above-mentioned attractive force. As a result, the states of the solenoid member 44 and the slider member change from the attracted state to the separated state. Under the separated state, the above-mentioned attractive force between the iron core 44*a* and the solenoid main body 44*b* does not act so that the fixing of the lock pin retention protrusion 42*a* at the lock position L is released. Therefore, the slider member 42 having the lock pin retention protrusion 42*a* is moved upward in the z-direction together with the iron core 44*a* by the biasing force of the lock pin operation end 6*b* by means of the elastic force of the contact spring 32.

The lock pin operation end 6*b* is configured to press and move the lock pin retention protrusion 42*a* upward in the z-direction by means of the biasing force F which is applied to the lock pin operation end 6*b*. Then, the lock pin operation end 6*b* abuts against the lock pin retention protrusion 42*a* so as to push up the lock pin retention protrusion 42*a* in the z-direction, and passes through the lock release passage IV (FIGS. 5A and 5B) which is opened by this pushing-up operation. Then, the lock pin operation end 6*b* reaches the position h.

During the period in which the lock pin operation end 6*b* abuts against the lock pin retention protrusion 42*a* so as to move the lock pin retention protrusion 42*a* upward in the z-direction, the slider member 42 including the lock pin retention protrusion 42*a* is applied with the return force G, which is directed downward in the z-direction, by means of the elasticity of the return spring 43. The return force G is set to be smaller than the biasing force F so that the lock pin retention protrusion 42*a* is moved upward in the z-direction.

Note that, there is formed, on the lock pin retention protrusion 42*a*, an inclined surface 42*b* which is inclined at an angle identical with the angle of the side wall forming the lock release passage IV. Therefore, there is an advantageous effect that the operation for releasing the locked state can be performed smoothly.

The biasing force F is applied to the lock pin retention protrusion 42*a* during the period in which the lock pin operation end 6*b* abuts against the lock pin retention protrusion 42*a* and slides. Then, at the point of time when the lock pin operation end 6*b* is separated from the lock pin retention protrusion 42*a*, the biasing force F is not applied to the lock pin retention protrusion 42*a* anymore, and only the return force G directed downward in the z-direction is applied. Then, by means of the return force G, the lock pin retention protrusion 42*a* of the slider member 42 is pressed down in the z-direction so as to return to the lock position L. Then, the solenoid member 44 returns to the attracted state while being interlocked with the movement of the lock pin retention protrusion 42*a*.

Namely, at the point of time when the lock pin operation end 6*b* presses the lock pin retention protrusion 42*a* upward in the z-direction by the biasing force F which is applied to the lock pin operation end 6*b*, the attractive force is generated between the iron core 44*a* and the solenoid main body 44*b*. At this point of time, when the lock release signal is momentarily input into the solenoid member 44, the biasing force F applied to the lock pin operation end 6*b* becomes larger than the sum of this attractive force and the return force F. Therefore, the lock pin retention protrusion 42*a* is moved upward in the z-direction.

Note that, the elastic force of the return spring 43 is suitably set in a way that the return spring 43 generates the return force downward in the z-direction when the slider member 42 moves upward in the z-direction. Under the state in which the slider member 42 is fixed to the solenoid member 44, the return spring 43 preliminary presses the slider member 42 downward in the z-direction, or does not preliminary press the slider member 42. In the case in which the slider member 42 is preliminary pressed downward in the z-direction, the return spring 43 preliminary presses the slider member 42 with an elastic force which is smaller than the biasing force F of the lock pin operation end 6*b*.

As mentioned above, the switch 1 is configured to include the plunger main body 31 for performing the opening and closing operations of the switch circuit by the pressing-in operation in a first direction (downward in the z-direction), the lock pin 6 having one lock pin fulcrum end 6*a* which is connected to the plunger main body 31, the heart cam portion 46 in which the outer circumferential groove 46*c* is disposed for guiding the lock pin operation end 6*b* at the side opposite to the plunger main body 31 in the lock pin 6 in accordance with the movement of the plunger main body 31, the lock pin retention protrusion 42*a* for retaining the lock pin operation end 6*b* which is biased in a second direction (upward in the z-direction) opposite to the first direction (downward in the z-direction), and retaining the lock pin operation end 6*b* at the locked position L, and the lock pin release mechanism for releasing the retention between the lock pin retention protrusion 42*a* and the lock pin operation end 6*b* by inputting the external signal.

Then, the heart cam portion 46 extends from the locked position L to the side to which the lock pin operation end 6*b* is biased, and includes the lock release passage IV which is blocked off by the lock pin retention protrusion 42*a* under the state of being retained. The lock pin release mechanism moves the lock pin retention protrusion 42*a* upward in the z-direction so that the lock release passage IV is opened so as to release the retention.

According to this structure, when the external signal is input, the lock pin operation end 6*b* under the locked state (of being retained by the lock pin retention protrusion 42*a*) is moved upward in the z-direction by means of the lock release mechanism. As a result, the lock pin retention protrusion 42*a* is moved upward in the z-direction so as to open the lock release passage IV, and the lock pin operation end 6*b* is made to slide in the lock release passage IV. Moreover, the lock release passage IV extends from the locked position L to the side to which the lock pin operation end 6*b* is biased so that the lock pin operation end 6*b* slides in the lock release passage IV without resisting its biasing force so as to release the locked state.

Therefore, according to the structure of the switch 1, as compared to the conventional switch with the reset function in which the lock pin operation end 6*b* is moved in the direction opposite to the biasing direction of the lock pin operation end 6*b* with the driving force greater than this biasing force (while resisting the biasing force of the lock pin operation end 6*b*), the wear between the lock pin 6 and the lock pin retention protrusion 42*a* can be decreased.

Accordingly, there can be provided a switch with a reset function which can decrease the wear between the lock pin 6 and the lock pin retention protrusion 42*a* for retaining the lock pin 6.

Moreover, the switch 1 includes the slider member 42 having the lock pin retention protrusion 42*a*, the solenoid member 44 having the iron core 44*a* and the solenoid main body 44*b* for fixing the lock pin retention protrusion 42*a* of the slider member 42 at the locked position L by the attractive force between the iron core 44*a* and the solenoid main body 44*b*, and the return spring 43 for generating the return force which is smaller than the biasing force of the lock pin operation end 6*b*. The lock pin release mechanism is configured to move the lock pin retention protrusion 42*a* upward in the z-direction by inputting the lock release signal into the solenoid member 44 so as to release the fixing between the slider member 42 and the solenoid member 44.

In the conventional switch with the reset function, the drive cam is driven by the attractive force of the solenoid via the iron core so as to be rotated about the cam protrusion portion in a counterclockwise, thereby using the principle of lever for the drive mechanism of the drive cam. As a result, there is a second problem that the switch is large in size.

Moreover, in the conventional switch with the reset function, when releasing the locked state, the drive cam is supported by only the iron core of the solenoid and the lock pin. As a result, there is a third problem that the drive cam is easily released from the lock pin when shock or vibration is externally applied to the drive cam.

According to the structure of the switch 1, the second and third problems in the conventional switch with the reset function do not occur.

In the switch 1, the slider member 42 having the lock pin retention protrusion 42*a* is fixed by the attractive force between the iron core 44*a* and the solenoid main body 44*b* in the solenoid member 44 so that the retention member for retaining the lock pin (the slider member 44 in this case) is more stably fixed than the conventional switch with the reset function. As a result, there is a reset function in which the sliding member is not released from the lock pin even when shock or vibration is externally applied to the sliding member.

Furthermore, in the lock pin release mechanism, the lock release signal is input into the solenoid member 44 so as to release the fixing of the slider member 42 and the solenoid member 44, thereby making the lock pin retention protrusion 42*a* movable upward in the z-direction. Therefore, the principle of lever, which is used for the conventional switch with the reset function, is not needed. As a result, there is a miniaturized switch with a reset function.

Moreover, in the lock pin release mechanism of the switch 1, the lock pin retention protrusion 42*a* is moved upward in the z-direction by the biasing force of the lock pin operation end 6*b* so as to open the lock release passage IV.

According to this structure, there is no need to dispose a member for moving the lock pin retention protrusion 42*a* upward in the z-direction at the lock pin release mechanism. Therefore, the release of the locked state has a simpler structure.

Moreover, the lock pin release mechanism in the switch 1 is configured such that the lock pin retention protrusion 42*a* is applied with the return force downward in the z-direction so as to return the lock pin retention protrusion 42*a* to the locked position L.

According to this structure, the lock pin release mechanism applies the return force to the lock pin retention protrusion 42*a* downward in the z-direction so as to return the lock pin retention protrusion 42*a* to the locked position L. As a result, an advantageous effect occurs such that, after the locked state is released, the locked state can be restored quickly, and the operation can be performed smoothly.

The present embodiments are not limited to the above, and can be modified within the scope shown by the claims so that the technical scope of the present embodiments also cover embodiments which can be obtained by suitably combining the technical means disclosed in the above-mentioned embodiment.

INDUSTRIAL APPLICABILITY

The present embodiments can be applied to electric appliances in which power switches can be turned OFF by external signals, such as a washing machine or a dish washer, etc.

There has thus been shown and described a switch with reset function using the same which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A switch with a reset function, comprising:

a press-in member which performs opening and closing operations of a circuit by a press-in operation in a first direction;

a lock pin including one end connected to the press-in member and an operation end that is on an opposite end of the lock pin from the press-in member;

a cam portion including a cam groove that guides the operation end when the press-in member moves;

a retention portion that retains the operation end biased in a second direction opposite to the first direction so as to hold the operation end in a locked position; and a release mechanism that releases a retention between the retention portion and the operation end by inputting an external signal, wherein the cam portion further includes a lock release cam groove that extends from the locked position to a side to which the operation end is biased, and is blocked off by the retention portion during the retention, and wherein the release mechanism moves the retention portion in the second direction to open the lock release cam groove, thereby releasing the retention.

2. The switch with the reset function according to claim 1, further comprising:

a sliding member including the retention portion;

a solenoid member including an iron core and a solenoid main body, the solenoid member is fixed to the sliding member by an attractive force between the iron core and the solenoid main body so as to fix the retention portion to the locked position; and an elastic member that generates a return force smaller than a biasing force of the operation end when the sliding member moves in the second direction, wherein the release mechanism makes the retention portion movable in the second direction by inputting the external signal into the solenoid member so as to release the attractive force.

3. The switch with the reset function according to claim 2, wherein the release mechanism moves the retention portion in the second direction by the biasing force of the operation end so as to open the lock release cam groove.

4. The switch with the reset function according to claim 3, wherein the release mechanism applies the return force to the retention portion in the first direction so as to return the retention portion to the locked position.

5. The switch with the reset function according to claim 4, wherein the cam portion includes:

a cam groove for an ON operation which guides the operation end in accordance with a movement of the press-in member during the ON operation; and a cam groove for an OFF operation which guides the operation end in accordance with a movement of the press-in member during the OFF operation.

6. The switch with the reset function according to claim 3, wherein the cam portion includes:

a cam groove for an ON operation which guides the operation end in accordance with a movement of the press-in member during the ON operation; and a cam groove for an OFF operation which guides the operation end in accordance with a movement of the press-in member during the OFF operation.

7. The switch with the reset function according to claim 2, wherein the release mechanism applies the return force to the retention portion in the first direction so as to return the retention portion to the locked position.

8. The switch with the reset function according to claim 7, wherein the cam portion includes:

a cam groove for an ON operation which guides the operation end in accordance with a movement of the press-in member during the ON operation; and a cam groove for an OFF operation which guides the operation end in accordance with a movement of the press-in member during the OFF operation.

9. The switch with the reset function according to claim 2, wherein the cam portion includes:

a cam groove for an ON operation which guides the operation end in accordance with a movement of the press-in member during the ON operation; and a cam groove for an OFF operation which guides the operation end in accordance with a movement of the press-in member during the OFF operation.

10. The switch with the reset function according to claim 1, wherein the release mechanism moves the retention portion in the second direction by the biasing force of the operation end so as to open the lock release cam groove.

11. The switch with the reset function according to claim 10, wherein the release mechanism applies a return force to the retention portion in the first direction so as to return the retention portion to the locked position.

12. The switch with the reset function according to claim 11, wherein the cam portion includes:

a cam groove for an ON operation which guides the operation end in accordance with a movement of the press-in member during the ON operation; and a cam groove for an OFF operation which guides the operation end in accordance with a movement of the press-in member during the OFF operation.

13. The switch with the reset function according to claim 10, wherein the cam portion includes:

a cam groove for an ON operation which guides the operation end in accordance with a movement of the press-in member during the ON operation; and a cam groove for an OFF operation which guides the operation end in accordance with a movement of the press-in member during the OFF operation.

14. The switch with the reset function according to claim 1, wherein the release mechanism applies a return force to the retention portion in the first direction so as to return the retention portion to the locked position.

15. The switch with the reset function according to claim 14, wherein the cam portion includes:

a cam groove for an ON operation which guides the operation end in accordance with a movement of the press-in member during the ON operation; and a cam groove for an OFF operation which guides the operation end in accordance with a movement of the press-in member during the OFF operation.

16. The switch with the reset function according to claim 1, wherein the cam portion includes:

a cam groove for an ON operation which guides the operation end in accordance with a movement of the press-in member during the ON operation; and a cam groove for an OFF operation which guides the operation end in accordance with a movement of the press-in member during the OFF operation.

* * * * *